US006232725B1

(12) United States Patent
Derra et al.

(10) Patent No.: US 6,232,725 B1
(45) Date of Patent: May 15, 2001

(54) CIRCUIT ARRANGEMENT FOR OPERATING A HIGH-PRESSURE DISCHARGE LAMP

(75) Inventors: Gunther H. Derra, Aachen; Hanns Ernst Fischer, Stolberg; Hans G. Ganser, Stolberg; Thomas Krucken, Aachen, all of (DE); Holger Moench, Vaals; Rob Snijkers, Landgraaf, both of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/464,006

(22) Filed: Dec. 15, 1999

(30) Foreign Application Priority Data

Dec. 17, 1998 (EP) ..... 98204288

(51) Int. Cl.[7] ..... H05B 37/00
(52) U.S. Cl. ..... 315/209 R; 315/224; 315/DIG. 5
(58) Field of Search ..... 315/246, 209 R, 315/326, 287, 219, 224, DIG. 5

(56) References Cited

U.S. PATENT DOCUMENTS 5,608,294 3/1997 Derra et al. ..... 315/224
5,880,561 * 3/1999 Miyazaki et al. ..... 315/209 R

FOREIGN PATENT DOCUMENTS 0944294 9/1999 (EP) .
WO9714275 4/1997 (WO) .

* cited by examiner

*Primary Examiner*—David Vu

(57) ABSTRACT

A circuit arrangement is provided for operating a high pressure discharge lamp with a lamp current which, in successive periods, has opposite polarities. The lamp is provided with at least two main electrodes being spaced an electrode distance from each other. The circuit arrangement includes input terminals for connection to a supply source, output terminals for connection to the high pressure discharge lamp, and an element, coupled to the input terminals, for supplying the lamp current to the high pressure discharge lamp, which current, in successive periods, has a predetermined shape. The circuit arrangement is provided with an element for detecting a first parameter indicative of the electrode distance and forming a first signal dependent on the first parameter and with an element for reshaping the lamp current, in successive periods, in dependence of the thus formed first signal.

7 Claims, 5 Drawing Sheets

CIRCUIT ARRANGEMENT FOR OPERATING A HIGH-PRESSURE DISCHARGE LAMP

BACKGROUND OF THE INVENTION

The invention relates to a circuit arrangement for operating a high pressure discharge lamp with a current having opposite polarities in successive periods, which lamp is provided with at least two main electrodes being spaced on an electrode distance from each other, the circuit arrangement comprising:

input terminals for connecting a supply source, output terminals for connecting the high pressure discharge lamp, and means, coupled to the input terminals, for supplying the lamp current to the high pressure discharge lamp, which lamp current, in the successive periods has a predetermined shape.

Such a circuit arrangement is known from U.S. Pat. No. 5,608,294. The known circuit arrangement provides a measure to suppress flickering of a high pressure discharge lamp and is in particular suitable for operating a high pressure discharge lamp in a projection system like a projection television apparatus. In the known circuit arrangement, the lamp is supplied with successive block shaped current pulses of opposite polarity. The suppression of flickering is achieved by supplying, during periods of the lamp current, additional current pulses with the same polarity at the end of a predetermined fraction of such a period of the lamp current. By means of the thus reshaped current pulses, the temperature of the electrode is raised to a relatively high value, which high temperature increases the stability of the discharge arc, because the discharge arc originates from the same place on the electrode in each cathodic phase and so flickering is substantially suppressed. The additional current is supplied in a regular sequence, preferably during each successive pulse. Although it is known that AC operation of high pressure discharge lamps with a low frequency alternating lamp current prevents a rapid erosion of the electrodes of the high pressure discharge lamp (further also referred to as the lamp) and allows operation of the lamp with a relatively high efficacy, it has occurred that lamps operated with the known circuit arrangement showed to have a continuous increase of the arc voltage over an operating time of several hundred hours, which voltage increase appeared to continue when the lamp was experimentally operated for several thousand hours. As a luminous output of the lamp being fairly constant over the life of the lamp is of vital importance for use in a projection system, a continues arc voltage increase forms a serious drawback in reaching a long lamp life.

In case a high pressure discharge lamp is operated with an AC current, each electrode of the lamp alternately functions as a cathode and as an anode during successive periods of the lamp current. During these periods the electrode is said to be in the cathodic phase and the anodic phase, respectively. Electrode material, that is removed from the electrode in the anodic phase, returns to the electrode as a stream of ions in the cathodic phase. These transport processes further complicate the behavior of the electrode temperature during each period of the lamp current, since the time dependency of the electrode temperature in the anodic phase differs from that in the cathodic phase.

SUMMARY OF THE INVENTION

It is an object of the invention to provide a circuit arrangement for operating a high pressure discharge lamp in a way which substantially overcomes the mentioned drawback and also maintains the substantial suppression of flickering of the lamp during its operation.

According to the invention, a circuit arrangement of the kind mentioned in the opening paragraph is characterized in that that the circuit arrangement is provided with means for detecting a first parameter indicative for the electrode distance and forming a first signal dependent on the first parameter, and with means for reshaping the lamp current in dependence on the thus formed first signal.

It has surprisingly occurred that with a controlled reshaping of the lamp current it is possible to substantially overcome the problem of continuous increase of the lamp voltage without significantly affecting lamp flicker suppression.

Further improvement with regard to discharge arc stability is achieved when the circuit arrangement further comprises:

means for detecting a second parameter indicative of the occurrence of lamp flicker and forming a second signal dependent on the detected second parameter, and means for further adjusting the shape of the lamp current in successive periods in dependence of the second signal.

Because the shape of the current flowing through the lamp is changed in accordance with the detection of occurrence of flickering, it is possible to suppress both the flickering to a level fully acceptable for optical projection and to simultaneously substantially control alterations in the electrode distance and thus counteract a continuous tendency of lamp voltage increase.

In an embodiment the first parameter is provided by the lamp voltage, preferably averaged over several periods.

In an embodiment of the circuit arrangement according to the invention the lamp voltage during each successive period provides the second parameter. Use of the lamp voltage for the second parameter has the advantage that the first and second parameter are both based on lamp voltage. This simplifies the circuit arrangement. In a first preferred embodiment the shape of the lamp voltage during each period is detected and used for forming the second parameter. Preferably this is realized by means in the circuit arrangement which measures the lamp voltage at selected intervals during such a period and compares the thus found values with each other. In a second preferred embodiment for forming the second parameter it is the value of the lamp voltage in successive periods at a fixed moment during each period, preferably at a moment of a constant lamp current, which are detected. In a practical embodiment this is preferably realized by means for measuring the lamp voltage at a moment close to the end of each period and comparing the outcome of consecutive periods having the same polarity. In a further embodiment the second parameter is formed by the luminous output of the lamp, for instance by means of optical detectors placed around a display area of a projection system, for instance at the edge of the display area.

Good results were obtained in cases where the frequency of the periods of opposite polarity of the lamp current was selected from the range 45 Hz–500 Hz.

BRIEF DESCRIPTION OF THE DRAWINGS

The above and further aspects of the invention will be explained in more detail below with reference to a drawing, in which.

DESCRIPTION OF THE PREFERRED EMBODIMENTS

Figure 1:
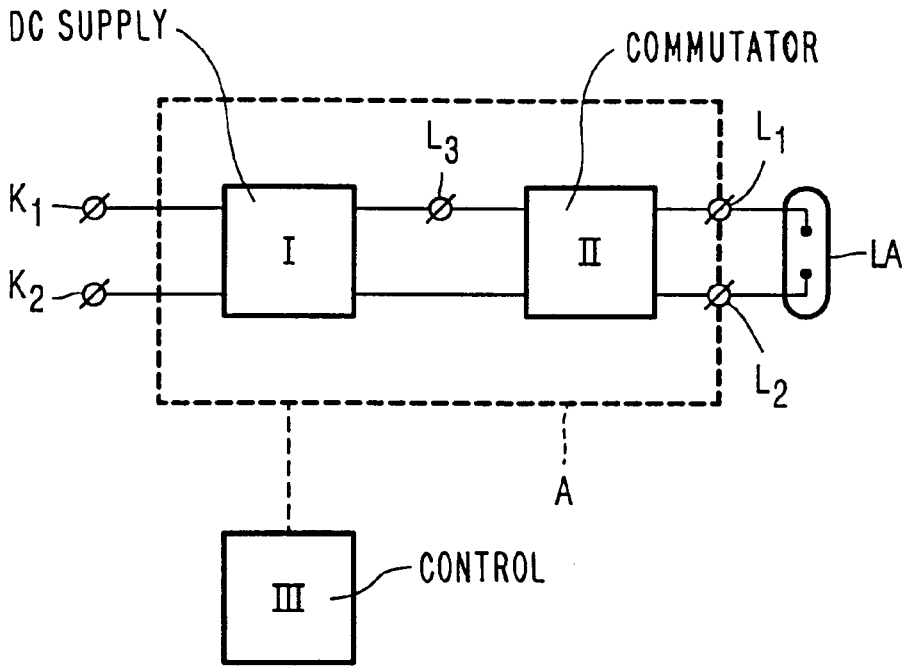
FIG. 1 shows an embodiment of a circuit arrangement according to the invention.

In FIG. 1, K1 and K2 denote input terminals for connection to a supply voltage source supplying a supply voltage. Coupled to K1 and K2, is means I for generating a DC supply current. Output terminals of a means I are connected to respective input terminals of commutator II. Output terminals of commutator II are connected by the high pressure discharge lamp La, which lamp is provided with at least two main electrodes being placed on an electrode distance from each other. Control means III controls the shape, in successive periods, of opposite polarities of the current supplied to the lamp by controlling the means I and incorporates both means for detecting a first parameter indicative for the electrode distance and forming a first signal dependent on the first parameter and means for adapting the lamp current in dependence of the thus formed first signal. Means I and means II together constitute means A, coupled to the input terminals, for supplying the lamp current to the high pressure discharge lamp, which lamp current, in successive periods has a predetermined shape.

The operation of the circuit arrangement shown in FIG. 1 is as follows.

When input terminals K1,K2 are connected to a voltage supply source, means I generates a dc supply current from the supply voltage supplied by the voltage supply source. Commutator II converts this dc current into an alternating current having successive periods of opposite polarity. By control means III the shape in the successive periods of the current thus formed and supplied to the lamp La is controlled. In a practical realization of the described embodiment the means I is formed by a rectifier bridge followed by a switch mode power circuit, for instance a Buck or down converter. Commutator II preferably comprises a full bridge circuit. Lamp ignition circuitry is preferably incorporated also in the commutator means II.

Figure 2:
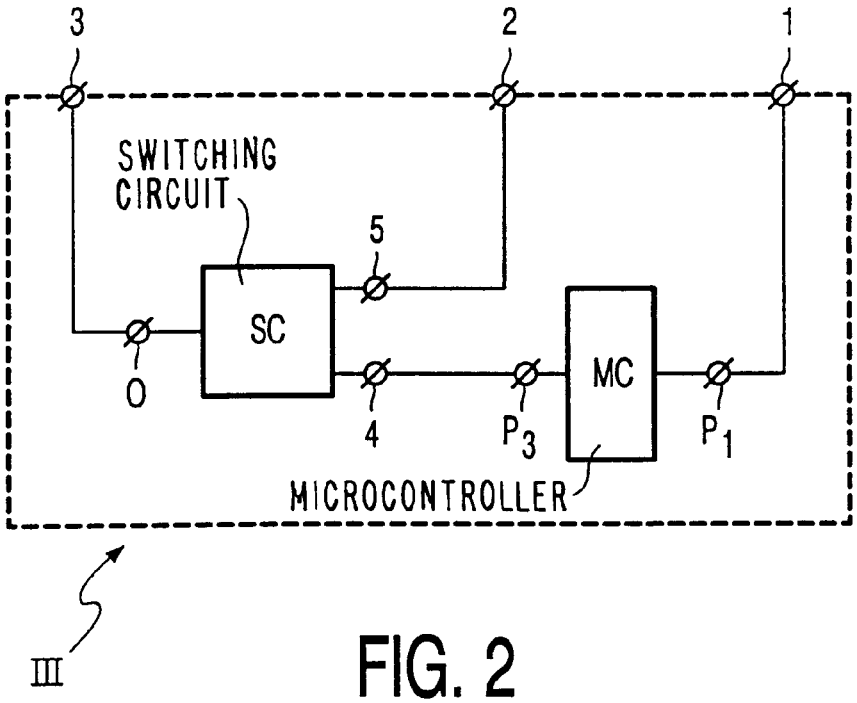
FIG. 2 shows a control means of an embodiment of a circuit arrangement according to the invention in accordance with FIG. 1.

In FIG. 2, the control means III for controlling means I is shown in more detail. The control means III comprises an input 1 for detecting the lamp voltage, for instance the voltage over the terminals L1,L2 connected to the lamp forming a signal representing the lamp voltage. Preferably the lamp voltage representing signal is formed by detecting a voltage at a connection point L3, as the thus detected voltage is a dc voltage which will not be disturbed by ignition voltage generated in the lamp ignition circuitry. Control means III further comprises an input 2 for detecting of the current through inductive means L of the converter forming the switch mode power circuit of the means I, which converter has at least a switch, and an output terminal 3 for switching the switch of the switch mode power circuit periodically in a conducting and a non-conducting state thus controlling the current through the induction means L of the converter. Input 1 is connected to connection pin P1 of a microcontroller MC. A connection pin P3 of the microcontroller is connected to an input 4 of a switching circuit SC. Input 2 is connected to an input 5 of the switching circuit SC, of which an output O is connected to output terminal 3. The microcontroller MC comprises forming means for detecting a first parameter indicative of the electrode distance and forming a first signal dependent on the first parameter as well as means for detecting a second parameter indicative of the occurrence of lamp flicker and forming a second signal dependent on the detected second parameter. The switching circuit forms means for reshaping of the lamp current in dependence on the thus formed first signal and means for further adjustment of shape of lamp current in successive periods in dependence on the thus formed second signal.

The operation of the circuit arrangement shown in FIG. 2, with the converter being a Buck or down converter, is as follows. The microcontroller MC is provided with software for performing procedures as further explained herebelow with reference to FIGS. 3 and 4. The procedures result in a converter peak current value which is fed to switching circuit SC at input 4 and used as reference for comparison with the detected current at input 2 which is also fed to the switching circuit SC, at input 5. Based on this current values comparison the switching circuit generates a switching off signal at output O, which switches the switch of the down converter in the non-conducting state when the detected current equals the peak current value. As a result the current through the inductive means will decrease. The converter switch is kept in the non-conductive state until the current through the inductive means L becomes zero. On detecting the converter current becoming zero the switching circuit SC generates at its output O a switch on signal that renders the switch of the down converter conductive. The current through the inductive means L now starts to increase until it reaches the peak current value. Such switching circuit SC is for instance known from W097/14275. The value of the peak current is refreshed as a result of the procedures performed by the microcontroller MC.

The detection of the lamp voltage is done with a frequency depending on the shape of the current to be realized through the lamp and is controlled by a built in timer of the microcontroller MC. Taking the lamp voltage as a lamp parameter for detection has as an advantage that it makes possible to have a wattage control of the lamp inherently incorporated in the microcontroller software. In case the lamp current itself is taken as parameter for detection a wattage control would not only require an additional detection of the lamp voltage, but also an additional control procedure in the microcontroller. The down converter operates in a preferred embodiment at a frequency in the range of 45 kHz to 75 kHz.

Figure 3:
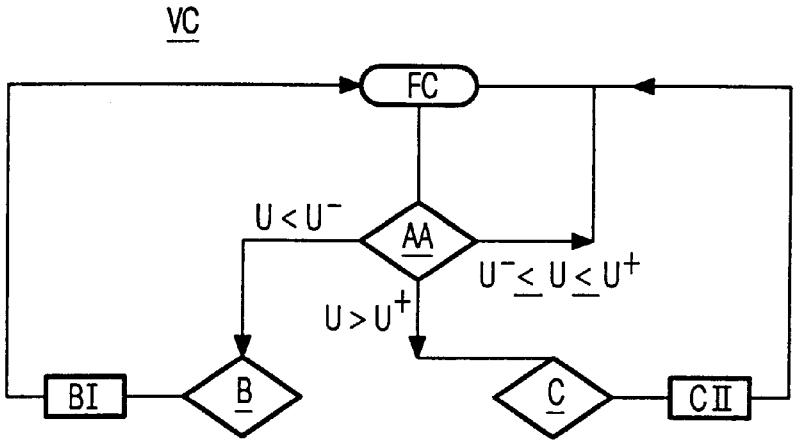
FIG. 3 shows a control procedure for operating the embodiment according to FIG. 2.

FIG. 3 shows a control procedure performed by the microcontroller MC of the control means III according to FIG. 2 A shown voltage control loop VC is started on a regular time basis, for instance once per minute from a flicker control loop FC. From a start SV the driver detects at AA whether the lamp voltage, is outside a preferred range. The lamp voltage as supplied via input 1 to connection pin P1, thus forms the first parameter. If the first parameter is not outside the preferred range the control procedure returns to the flicker control loop FC which is explained in detail below. If the lamp voltage is detected at AA to be below a minimum level U− the shape of the successive periods of opposite polarity forming the lamp current, further called mode of operation, is established as stored at B. Too low a lamp voltage indicates that the electrode distance has become too small due to electrode tip growth. The control switches at BI to a next shape of periods from a look up table I which counteracts electrode growth or even promotes electrode distance increase. The new selected shape is stored in B. Then the control procedure returns to loop FC. If the lamp voltage detected at AA is above a maximum level U+ the mode of operation detected at C is switched at CII to a next mode according to a look up table II and the control procedure returns to loop FC. The new selected mode is stored at C. Too high a lamp voltage indicates that the electrode distance has become too large and so the new selected mode is a mode which promotes electrode tip growth. Preferably, look up table II is the inverse of look up table I.

The detected voltage values are, in the case of the described embodiment, values of the lamp voltage taken at a fixed moment of each successive period, preferably at the moment 0.75 tp, but at least at a moment that the lamp voltage tends to be stable.

Figure 4:
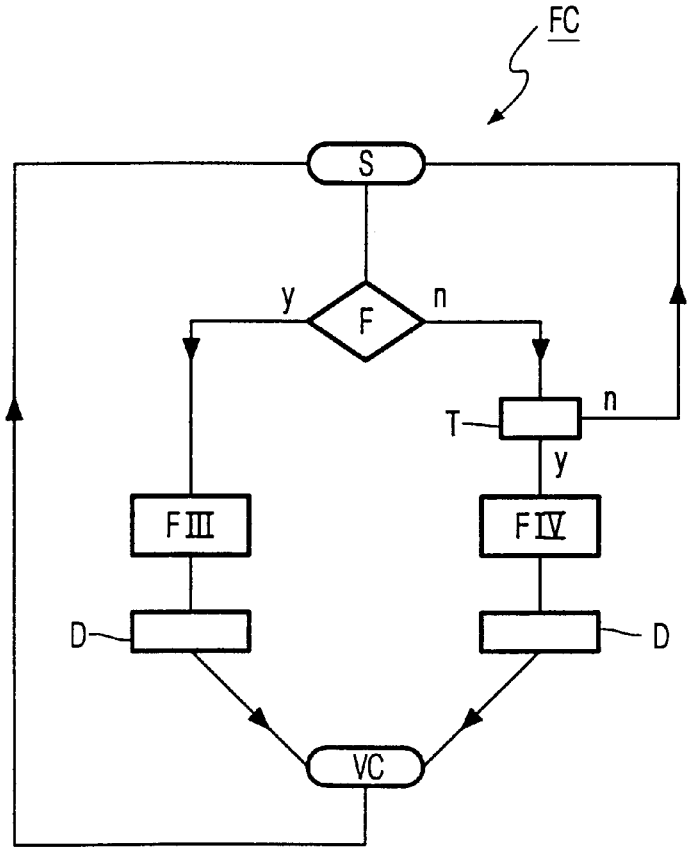
FIG. 4 shows a flicker control loop for performing part of the control procedure according to FIG. 3, and FIGS. 5 to 10 show different shapes of lamp current provided by the circuit arrangement according to FIG. 1 during successive periods.

In a diagram shown in FIG. 4 the flicker control loop FC is illustrated. From a start S the driver detects at F whether flicker is occurring. If so the mode of operation is switched at FIII to a next one according to a look up table III. After a delay period D, to let the lamp operation stabilize, the control procedure switches to the voltage control loop VC. If no flicker is detected at F it is determined at T if lamp operation is free of flicker for a period >T. If not the control procedure returns to S. If, however, the lamp operates flicker free for a period >T, then the control procedure forces at FIV the switching over to a next mode of operation according to the look up table IV. After a delay period D, to let the lamp operation stabilize, the control procedure switches to the voltage control loop VC. Preferably look up table IV is the inverse of look up table III.

Figure 5:
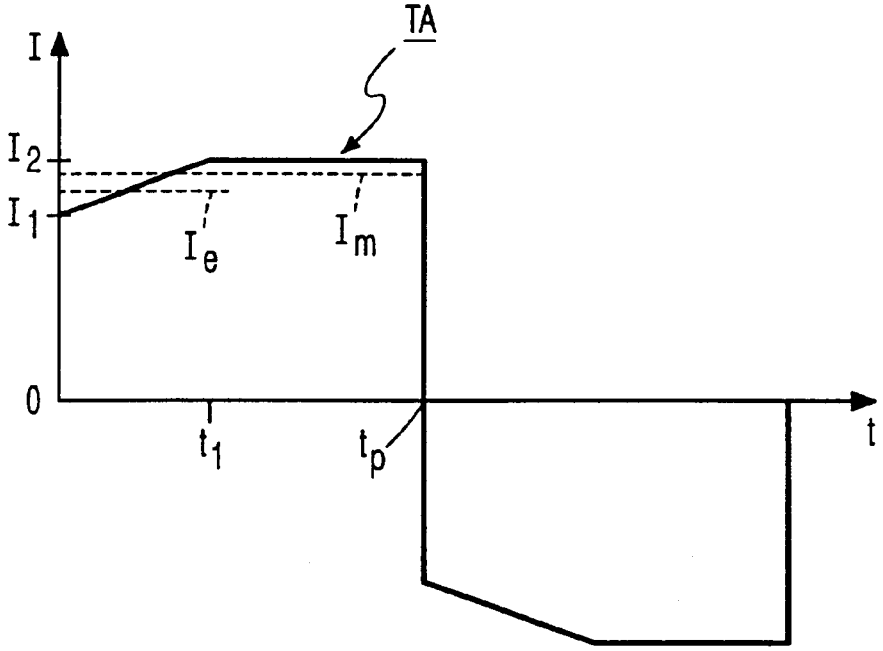

Different shapes of successive periods forming the lamp current defining different modes of operation are hereafter described with reference to FIGS. 5 to 10 for 2 successive periods with opposite polarity. The current is represented along the vertical axis in a relative scale. Along the horizontal axis the time is displayed. For a first period TA of time duration tp as shown in FIG. 5 the lamp current has a mean value Im and over a first part of the period with time duration t1 a lower mean value Ie and over a second part of the period a current I2 being larger than Im. The value of the current I1 at the beginning of the period t1 corresponds to a diffuse stable attachment of the discharge to an electrode of the lamp. For flicker free operation it was established that $0.3 \leqq Ie/Im \leqq 0.9$. In the described embodiment the ratio Ie/Im has a value 0.7 and the ratio t1/tp a value 0.2.

This mode provides for flicker free operation and also for growth of the electrode tips and so reduction of the electrode distance.

Figure 6:
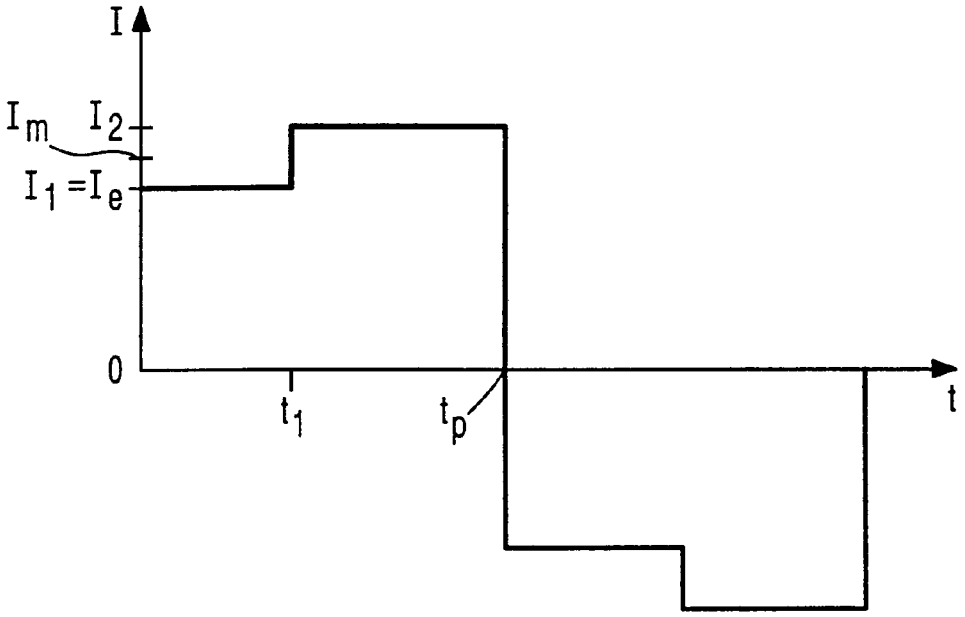

In FIG. 6 is shown the lamp current of an alternative mode of operation in which the current over the first part of the period is held constant at the value which allows for a diffuse stable attachment of the discharge to the electrodes, herewith defined as thermionic emission of the electrode. Therefore the mean value of the current over this first part Ie is at most equal to the maximum current that could be supplied by the electrodes through thermionic emission.

This mode provides for flicker free operation and also for growth of the electrode tips and so reduction of the electrode distance.

Figure 7:
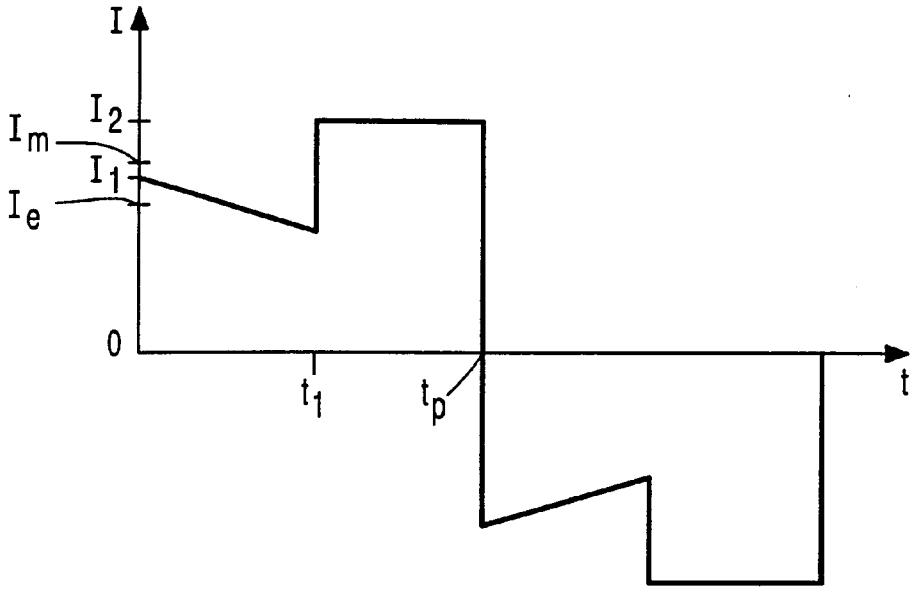

According to a further preferred mode the resulting current is shown in FIG. 7. In this case the current 11 at the start of the period is higher than Ie.

Also this mode provides for flicker free operation and also for growth of the electrode tips and so reduction of the electrode distance.

Figure 8:
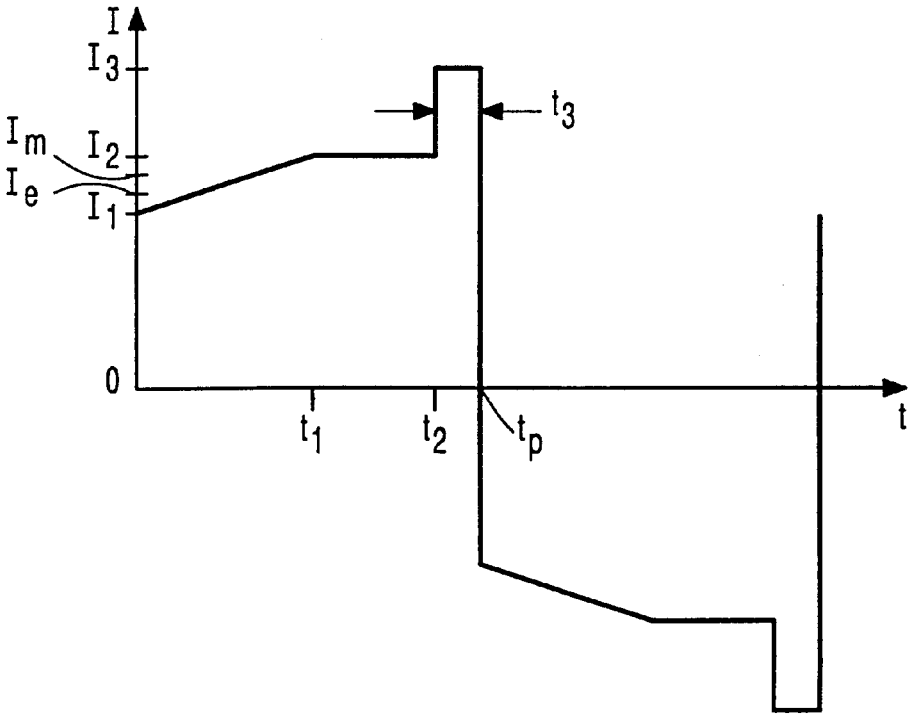

In FIG. 8 is shown a graph of the current according to another mode of operation in which the lamp current is provided with a pulse of the same polarity at the end of the period with a value I3. For fulfilling the object of stable operation (flicker free) it has been established that the requirements $1.4 \leqq I3/Im \leqq 4$ and $0.02 \leqq t3/tp \leqq 0.25$ should be fulfilled, in which t3 is the pulse width. In a practical realization of the described embodiment the value of I3 is 1.61 Im. From experiments it has been deduced that I3 is preferable chosen in the range $0.6 \leqq I3/Im \leqq 3$.

For causing lamp voltage reduction with a current shape according to FIG. 8 it has been established that $0.02 \leqq t3/tp \leqq 0.25$ and $t2/tp \leqq 0.5$ are fulfilled. Best results are achieved if $t2/tp \geqq 0.75$. Preferably tp fulfills the relation $tp = t2 + t3$ with $0.06 \leqq t3/tp \leqq 0.12$.

Figure 9:
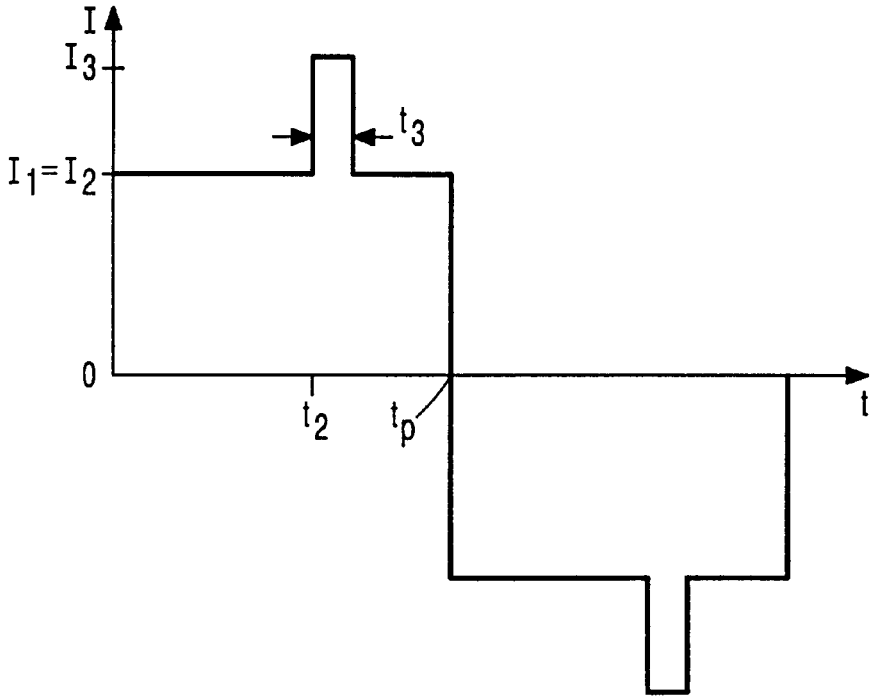

In FIG. 9 is shown a current shape which is suitable for increasing the lamp voltage. Here the following relations should apply: $I2 = I1$; $1.3 \leqq I3/Im \leqq 4$; $0 \leqq t2/tp \leqq 0.98$; $0.02 \leqq t3/tp \leqq 0.25$. Herein t2 is the time lapse between start of the period and start of the additional current pulse.

Figure 10:
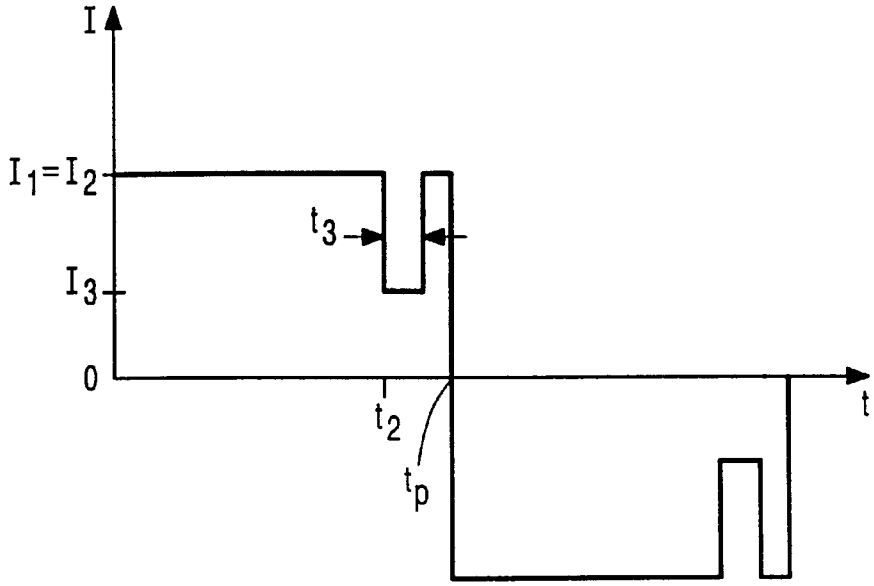

A current shape as shown in FIG. 10 in which an additional current pulse of opposite polarity is applied, is also suitable for causing lamp voltage increase. The necessary relation to be fulfilled are: $I1 = I2$; $0.1 \leqq I3/Im \leqq 0.7$; $0.5 \leqq t2/tp \leqq 0.98$ $0.02 \leqq t3/tp \leqq 0.25$. Particularly when the current at the end of the period p is smaller than Im, the current shape is effective for lamp voltage increase.

A practical embodiment of a circuit arrangement as shown in FIG. 1 has been used for the operation of a high pressure discharge lamp of the type UHP, from Philips Electronics. The lamp had a nominal power consumption of 100 Watt and an electrode distance of only 1.4 mm, was operated with two different modes of operation defining different shapes, in successive periods, of the lamp current. In a first mode of operation, during successive periods, current pulses of opposite polarity are shaped as shown in FIG. 9. The value of the current in this mode corresponding to I1 is regulated by way of a wattage control incorporated in the microcontroller software to a nominal value of 1.06A. The maximum value for I3 is fixed at 2.5A. The period duration tp is 5.6 ms, with an operating frequency of the commutator means II of 90 Hz, and the ratio t3/tp is controlled to be 0.08 with $t2 + t3 = tp$. As long as the lamp voltage, having a nominal value of 85V, is above 68V the current I3 is fixed at 2.5A. In case the detected lamp voltage has decreased to 68V the periods are reshaped by the means A in that the current I3 is stepped down in 3 steps to the value of I1, after which the means A switches over to a second mode of operation in which the supplied lamp current is formed by pulses shaped as rectangular blocks with a value controlled with the same wattage control as mentioned for the first mode at the same nominal value as I1. Thus the voltage minimum level U− is 68V. For the voltage maximum level U+ a value of 110V is used. As microcontroller MC a P87C749EBP, from Philips Electronics has shown to be suitable when programmed to detect the lamp voltage once at a fixed moment during each period, preferably at 0.75 tp.

The thus detected lamp voltage also forms the second parameter. The detected values during successive periods of equal polarity are compared for detecting occurrence of discharge attachment on the electrodes tending to become unstable and used for detecting flicker. For a thus detecting voltage difference a value of>1V occurring more than once over a time span of 2 minutes is set in the software as a threshold for the occurrence of lamp flicker. In a further practical embodiment the detection of lamp flicker is based on comparison of the found voltage differences of the detected voltages with 3 different thresholds each corresponding with a separate repetition rate, to detect both lamp flicker of high and of low frequency with high accuracy. The values of the thresholds and corresponding repetition rates are giving in the following table:

TABLE

| Voltage value in V | Repetition rate in s |
|---|---|
| 1 | 120 |
| 0.3 | 30 |
| 0.1 | 5 |

What is claimed is:

1. Circuit arrangement for operating a high pressure discharge lamp with a current, during successive periods, of opposite polarities, which lamp is provided with at least two main electrodes being spaced an electrode distance from each other, the circuit arrangement comprising:

input terminals for electrical connection to a supply source, output terminals for electrical connection to the high pressure discharge lamp, and means, coupled to the input terminals, for supplying the lamp current to the high pressure discharge lamp, characterized in that the circuit arrangement includes means for detecting a first parameter indicative of the electrode distance and forming a first signal dependent on the first parameter, and with means for reshaping the lamp current in successive periods in dependence on the first signal.

2. Circuit arrangement according to claim 1, wherein the circuit arrangement further comprises:

means for detecting a second parameter indicative of the occurrence of lamp flicker and forming a second signal dependent on the detected second parameter, and means for a further adjustment of the shape of the lamp current in successive periods in dependence on the second signal.

3. Circuit arrangement according to claim 1 characterized in that the first parameter is representative of the lamp voltage.

4. Circuit arrangement according to claim 2, characterized in that the second parameter is representative of the lamp voltage during successive current periods.

5. Circuit arrangement according to claim 4 characterized in that the lamp voltage during each period has a shape which is detected.

6. Circuit arrangement according to claim 4 characterized in that the lamp voltage during each period has a value which is detected.

7. Circuit arrangement according to claim 2, characterized in that the second parameter is representative of the luminous output of the lamp.

* * * * *